United States Patent [19]

Pelle

[11] Patent Number: 4,863,160

[45] Date of Patent: Sep. 5, 1989

[54] EXERCISE AND TRAINING DEVICE

[76] Inventor: Ralph D. Pelle, 1932 S. 50th Ave., Cicero, Ill. 60650

[21] Appl. No.: 221,295

[22] Filed: Jul. 19, 1988

Related U.S. Application Data

[62] Division of Ser. No. 3,726, Jan. 16, 1987, Pat. No. 4,790,529.

[51] Int. Cl.[4] ..... A63B 63/04; A63B 69/20; A63B 69/32; A63B 69/40

[52] U.S. Cl. ..... 272/93; 273/118 R; 273/129 Q; 446/168; 211/14; 211/182; 193/38; 193/DIG. 2; 272/DIG. 5

[58] Field of Search ..... 272/93, 63, 100, DIG. 5; 273/118 R, 121 R, 122 R, 128 A, 129 Q; 446/168, 169, 170; 211/13, 42, 43, 49.1, 182, 14; 248/166; 206/315.9; 224/919; 193/2 R, 6, 2 C, 25 FT, 35 R, 38, DIG. 2; 312/121, 124

[56] References Cited

U.S. PATENT DOCUMENTS

| | | | |
|---|---|---|---|
| 556,333 | 3/1896 | Collins | 446/170 X |
| 1,630,345 | 5/1927 | Lanza | 193/38 |
| 1,977,739 | 10/1934 | Sandstrom | 273/118 R |
| 2,198,075 | 4/1940 | Borek | 446/170 X |
| 2,224,776 | 12/1940 | Bermann | 446/170 X |
| 3,215,436 | 11/1965 | Carter | 273/129 Q X |
| 3,325,131 | 6/1967 | Englander et al. | 193/38 X |
| 3,326,309 | 6/1967 | Swearengen | 193/2 R X |
| 3,854,688 | 12/1974 | Shuford | 193/38 X |
| 4,251,008 | 2/1981 | Bruneau | 193/44 X |

*Primary Examiner*—Richard J. Apley
*Assistant Examiner*—David J. Bender
*Attorney, Agent, or Firm*—Balogh, Osann, Kramer, Dvorak, Genova & Traub

[57] ABSTRACT

A multi-positionable arrangement of substantially parallel bars which form a substantial track for a ball and for disposing the track to a position accessible to the feet, legs, hands and arms of the body to be exercised. The bars are adjustably spaced apart to provide for adjustment of contact engagement with ball surface so that repeated stroking of the ball on the track path requires striking contact at a particular point on the ball surface and thereby exercise of some specific body muscles and reflexes.

4 Claims, 2 Drawing Sheets

FIG. 6
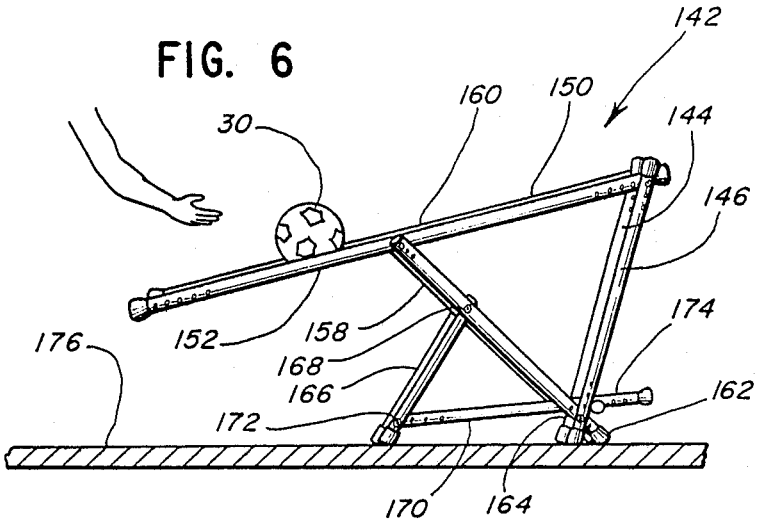
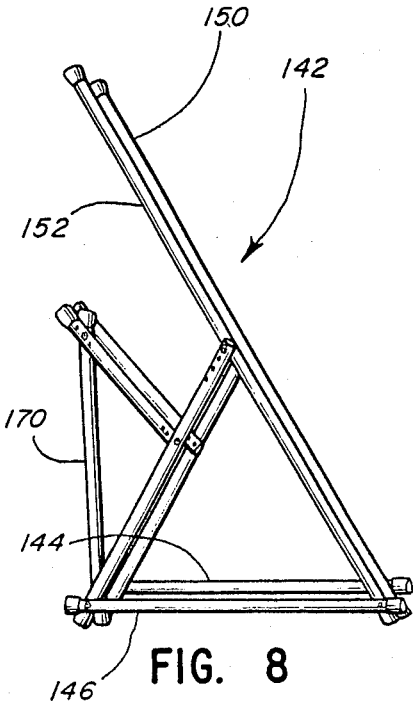
FIG. 8
FIG. 7
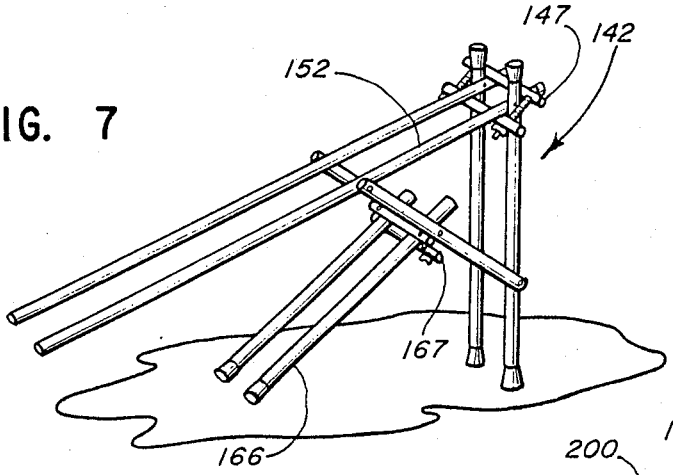
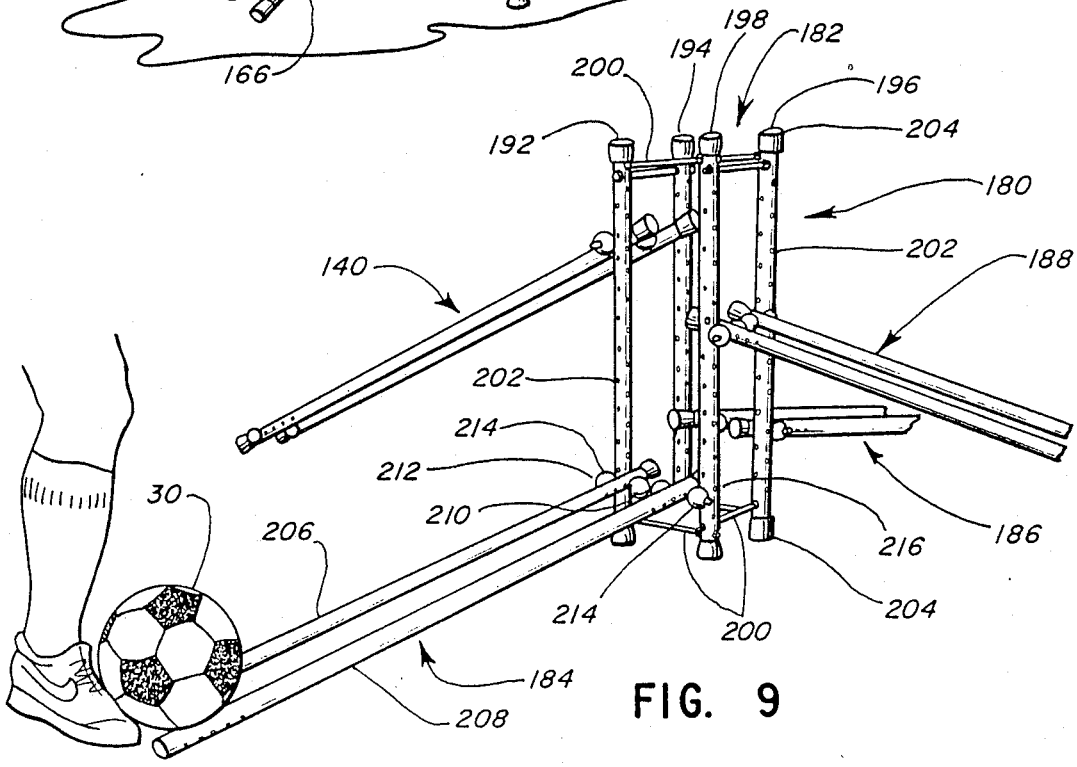
FIG. 9

EXERCISE AND TRAINING DEVICE

This is a divisional of co-pending application Ser. No. 003,726 filed on Jan. 16, 1987, now U.S. Pat. No. 4,790,529.

BACKGROUND OF THE INVENTION

1. Field of the Invention

This invention relates to an exercise and training device, and in particular to a device for developing muscles and muscular reflexes in hands, arms, legs, feet and neck, and for developing skills important to the play of various athletic games.

2. Description of the Prior Art

Exercise and training devices which perform two functions, increasing strength in the various members of the human body and which can be further used to develop reflex skills in athletic encounters, are very limited.

A soccer training and practice device is described in U.S. Pat. No. 4,478,428, which describes a trampoline forming a playing surface provided on one side with a rebounder, and elastic ball-retaining cords circumscribing the periphery of the playing surface. A player stands on the playing surface and kicks a soccer ball toward the rebounder, which redirects the ball toward the player. This device is only useful for imparting skill in the art of kicking.

SUMMARY OF THE INVENTION

A versatile exercise and training device is provided for exercising various portions of a body of an individual using the device, and further for developing skills in the control and movement of an inflated ball.

By means of a simple adjustment structure it is possible to provide a exercise device that can be used to develope muscle strength and reflexes of limitless possibilities and in a compact time frame. For example, different types of kicks of a soccer ball, that is, over-ball kick, under-ball kick, side-ball kick, can be practiced and perfected to give proper line of motion and follow-through on a relatively small apparatus without the need for retrieving the ball after it has been kicked away in the field. This permits dozens or hundreds of practice kicks to be preformed in a period of time that would be required for only a fraction of the number of strokes that could be made in an open field. Hence, the apparatus of this invention would permit more practice strokes in a given time period. This would also apply to the hand and arm stroking of basketball shots or any other type of arm or leg action at leg level or waist level or shoulder level to provide for the exercise strokes that would be required by many sports.

One object of the invention is to provide a device which defines a path along which a ball can be moved by an individual, the path being declined toward the individual for gravity return of the ball, or the device being provided with means for causing a return of the ball.

Another object of the invention is to provide an exercise device that can be used generally along a horizontal or a inclined plane.

A further object of the invention is to provide a device which can be adjusted in height to define different angular elevations of a path which will determine the rebounding speed of a ball toward the individual.

A further object is to provide a versitile "univeral" form of apparatus to accomodate the exercising and reflex development of the strength and control function of any particular muscle of the human body extremities.

Another object is to provide a versitile exercise device utilizing a ball and which can be used to exercise the muscular development and dexterity of people who are blind.

BRIEF DESCRIPTION OF THE DRAWINGS

FIG. 6 is a training apparatus adjusted for exercising hands;

FIG. 7 is a modified form of the exercise and training apparatus for exercising legs adjusted for moderate exertion;

FIG. 8 is an exercise and training device adjusted for strenuous exertion; and FIG. 9 is an exercise and training apparatus arranged for accommodating more than one individual.

DESCRIPTION OF THE PREFERRED EMBODIMENTS

Figure 1:
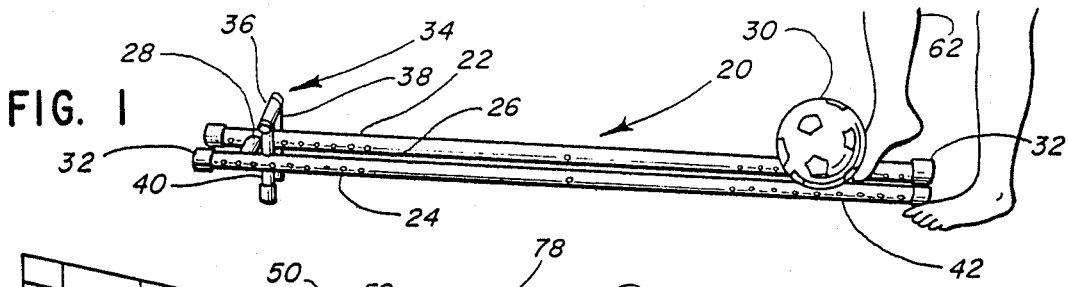
FIG. 1 illustrates the basic form of an exercise and training device employed generally in a horizontal plane.
Figure 2:
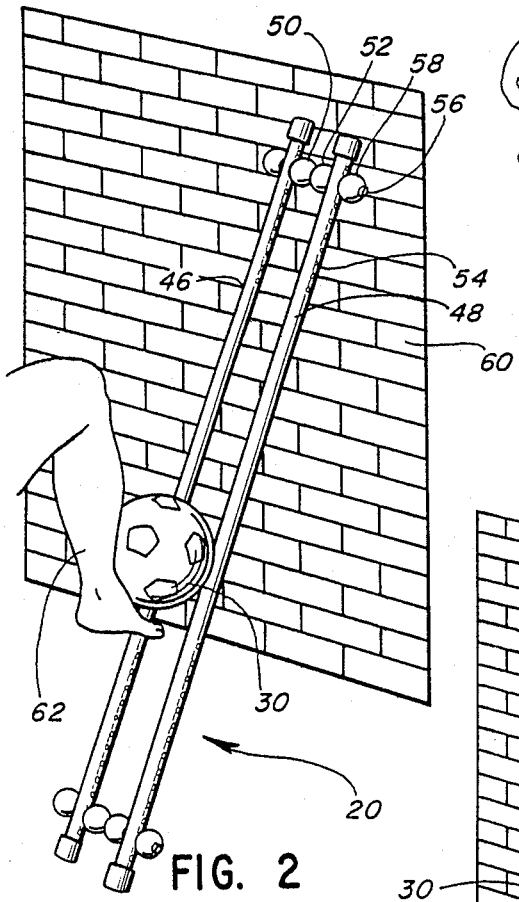
FIG. 2 shows the use of the device in a generally vertical plane.

FIGS. 1 and 2 show the basic form of exercise and training device 20 comprising a pair of elongated members 22 and 24 which are spaced apart to define a ball rolling path, the spacing being achieved by a spacer 28 which is wide enough to accommodate a game ball 30. The elongated members 22 and 24 are provided with cushion caps 32 to prevent injury to the user.

The far end of the device 20 is elevated by an adjustable height bracket 34 to give an inclination to the elongated members 22 and 24 which provide gravity return of the ball 30. The bracket 34 comprises an upper member 36 coupled by a pair of uprights 38 and 40.

Both ends of the elongated members 22 and 24 are provided with a plurality of holes 42 which are adapted to receive a horizontally disposed stud (not shown) cooperatively engaged with the uprights 38 and 40. Adjustable connecting means of any known form height used in place of the studs.

FIG. 2 illustrates a basic exercise and training device 20 similar to that shown in FIG. 1 except that no elevating bracket 34 is used. For example, elongated members 46 and 48 are spaced from each other by a pair of spacing balls 50 and 52 supported by studs 56 passing through any of the holes 54 in the elongated members 46 and 48. Studs 56 have ends terminated by clip balls 58. In this form, the device 20 is placed against a wall 60 so that a particular set of muscles in a leg 62 is exercised, as opposed to those that would be exercised in the leg 62 shown in FIG. 1.

Figure 2A:
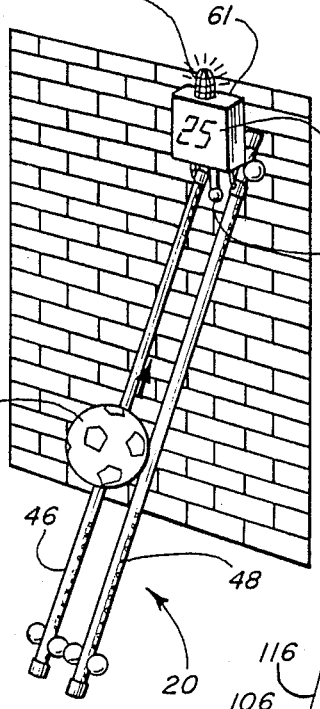
FIG. 2A above the device is equipped with an indicator.

The training device 20 can be equipped with a audio or visual indicator signal device or counter 61 clamped on the members 46, 48, as shown in FIG. 2A. This might have digital read-out face 63 or a flasher 65 or a ball. A ball activated trigger 67 is pivotally suspended from the counter 61 and will actuate the read-out face 63 and/or the flasher 65 or the ball, by known electrical or mechanical means whenever the ball is kicked upwardly high enough to strike the trigger 67. If a counter is employed, it will enable the player to keep track of the number of times the ball was properly kicked.

Figure 3:
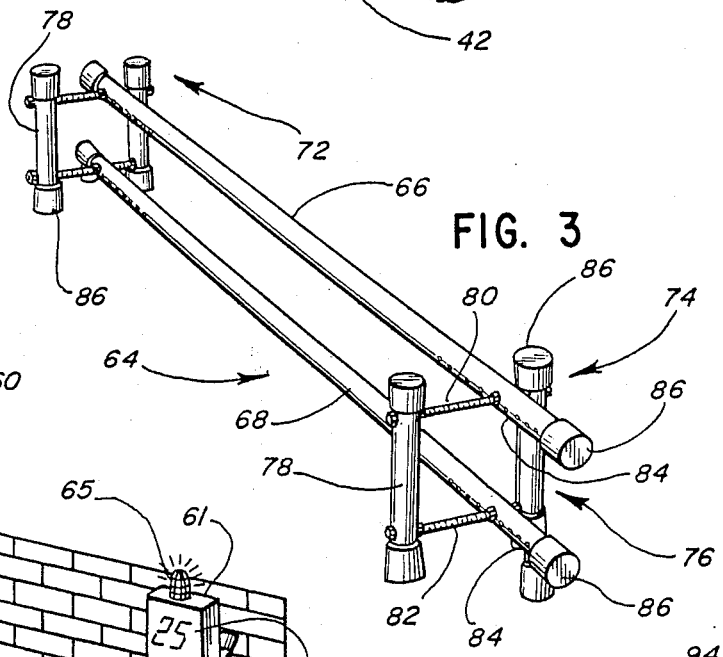
FIG. 3 illustrates an embodiment wherein a playing or exercise path is established in substantially horizontal plane.

A device which can be used for improving the skills of controlling and stroking the ball in the game of soccer is shown in FIG. 3, wherein a device 64 comprises a pair of elongated members 66 and 68 defining a ball engaging plane disposed in a somewhat vertical plane as opposed to a ball path along a somewhat horizontal plane as shown in FIGS. 1 and 2. The members 66 and 68 are spaced a predetermined distance from each other by a pair of brackets 72 and 74. For example, bracket 74 comprises a pair of uprights 76 and 78 supporting a pair of studs 80 and 82 passing through holes 84 in the elongated members 66 and 68. The ends of the elongated members 66 and 68, as well as to uprights, are provided with cushion caps 86. It should be noted that the upper elongated member 66 can be positioned in a vertical plane which is different from the vertical plane occupied by the lower elongated member 68, so that an angular path can be provided for hitting or stroking a soccer ball to make it roll along the path defined by the spaced members 66 and 68.

If the lower member 68 is moved to occupy a position below the upper member 66, the ball will be entirely supported on a floor for kicking exercises. On the other hand, if the lower member 68 is moved to an extreme position so that it abuts the uprights 78, then the ball will be supported entirely by the members 66 and 68. This characteristic of the structure requires that the ball that will be repeatedly stroked by the hand or foot will follow along the path provided by the elongated bars and will in fact be required to be struck at a different point on the surface of the ball. In one arrangement of the bars, the ball will be required to be struck from the top outer side, while in another arrangement of the bars, the ball will be required to be struck from the bottom middle, to best keep the ball on track. This will bring into play different muscles. One knowledgeable in muscular development would be able to advise as to the most beneficial portions of the bones to achieve the greatest benefit to those specific muscles sought to be exercised and developed. It is in this respect that the present invention is considered to be most advantageous, that is, it is extremely simple but can be adjusted to provide exercise in infinite ways. Whereas complex connection exercise apparatus provides exercise of only a limited number of muscles, the present invention which is extremely simple is capable of adjustment to provide exercise of any number of related muscles.

Figure 4:
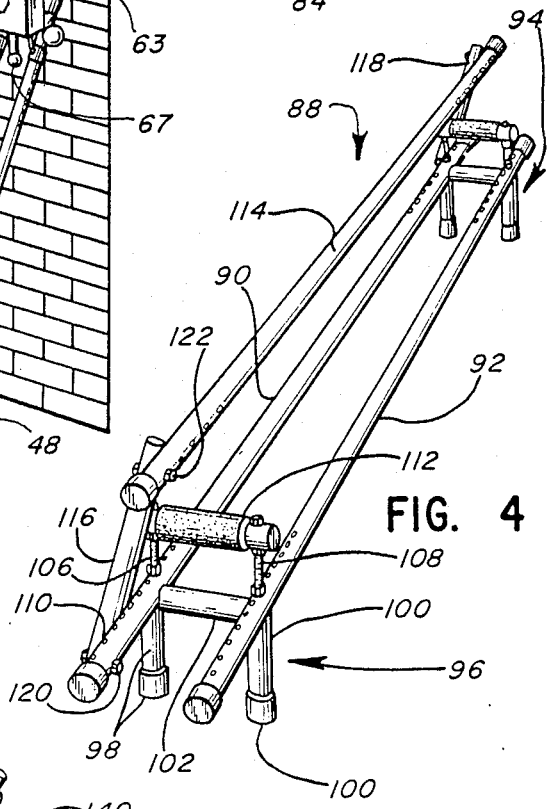
FIG. 4 is another form of an exercise and training device primarily for floor use.

A modification of the device shown in FIG. 3 is illustrated in FIG. 4, wherein an additional elongated member 92 is provided to define a ball engaging path generally along a horizontal plane. A device 88 comprises a pair of elongated members 90 and 92 disposed generally in a horizontal plane and spaced from each other by a pair of brackets 94 and 96. Bracket 96, for example, comprises a pair of uprights 98 and 100 separated by a spacer 102. The uprights 98 and 100 have extending studs 106 and 108 which pass through holes 110 in the elongated members 90 and 92. Alternatively, any known adjustable engaging arrangement may be used here. The extending ends of the studs 106 and 108 support a bumper 112 a predetermined distance above the ball rolling path defined by the members 90 and 92. The function of the bumper is to impart resilient action to a rebounding ball placed to roll along the path defined by the members 90 and 92. An elongated member 114 is positioned above the member 90 at a predetermined distance defined by support bars 116 and 118. For example, support bar 116 is pivotally attached to the member 90 by a stud 120, and the other end of the support bar 116 is pivotally attached by a stud 122 to the member 114. The height of the member 114 over the member 90 can be adjusted by pivoting the support bars 116 and 118 about the studs 120. With the device 88, a player can impart spinning motions to a soccer ball in a vertical or a horizontal plane, as well as in between, and still maintain the ball in a playing position on the device.

As an alternative, the device 88 may be modified to eliminate the elongated members 90, 92 so that a ball will be entirely supported on a floor surface and subject to guidance effected by the elongated member 114 which is adjustable to any desired distance from the floor surface. In this modification it would obviously require a different striking position of the ball, thereby requiring a different muscle motion.

Figure 5:
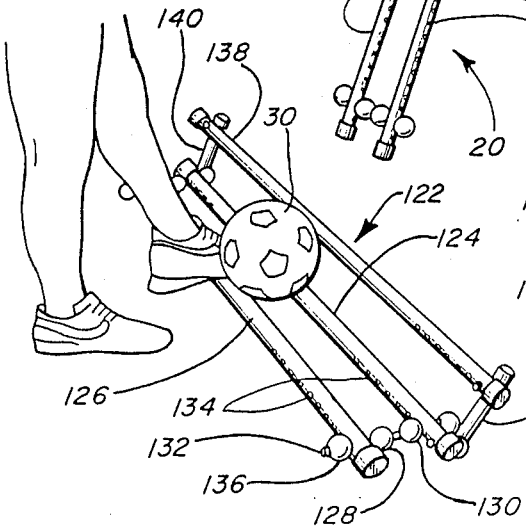
FIG. 5 is a still further form of the exercise and training device intended for floor use.

A modification of the device shown in FIG. 4 is illustrated in FIG. 5, wherein a device 122 comprises a pair of elongated members 124 and 126 which are spaced from each other by spacing balls 128 and 130 supported by studs, such as stud 132 which passes through holes 134 in the members 124 and 126, the ends of the stud 132 terminating in clip balls 136. An additional elongated member 138 is supported upwardly from the member 124 by a pair of uprights 140, the lower ends of which are attached to the member 134 in an appropriate manner.

An exercise and training apparatus 142 for exercising the arms and hands of a player is shown in FIG. 6. The apparatus 142 comprises a pair of legs 144 and 146 which are spaced from each other so that the upper ends thereof accommodate a pair of spaced elongated members 150 and 152 along a stud 154 which passes through the upper ends 148 of the legs 144 and 146 and ends 156 of the elongated members 150 and 152. The members 150 and 152 can be spaced from each other, for example, as by spacer balls 50 and 52 shown in FIG. 2.

The mid-portions of the members 150 and 152 are pivotally supported from ends of a pair of spaced members 158 engaged by a stud 160. Lower ends 162 of the members 158 are pivotally secured by a stud 164 passing through the legs 144 and 146. A mid-portion of the members 158 is pivotally connected to a pair of short spaced legs 166 by a stud 168. The lower portion of the legs 166 is pivotally coupled to an adjusting bar 170 by means of a stud 172. The adjusting bar 170 has a ratchet end 174 which is adapted to adjustably engage the stud 164 for adjusting the angularity of the members 150 and 152 with respect to a floor 176.

For example, if it is desired to increase the angularity of the members 150 and 152, the adjusting bar 170 can be placed in its extreme position so that ends 178 of the members 150 and 152 will rest close to the floor.

FIG. 7 shows a modification of the structure of FIG. 6 wherein adjusting bar 170 is eliminated. Adjustable pinch bars 167 serve to lock the angular relationship between pivoted members 158 and 166. Adjustable connector bars 147 provides for easy slidable connection between members 146 and 150.

Referring to FIG. 8, the exercise and training apparatus 142 can be placed in a further position to require additional exertion in moving a ball to a higher elevation. The apparatus 142, in FIG. 8, has been placed so that the legs 144 and 146 will rest on a floor so that the elongated members 150 and 152 will define a rolling path for the ball 30 at a severe angle compared to the angles shown in FIGS. 6 and 7.

FIG. 9 shows an exercise and training apparatus 180 comprising a central support 182 providing vertical adjustability to a plurality of ball rolling path means 184, 186, 188, and 190. The central support 182 comprises a rectangular arrangement of four uprights 192, 194, 196, and 198. The rectangular disposition of the uprights 192, 194, 196, and 198 is obtained by spacing studs 200 which pass through holes 202 in the uprights which are provided with cushion caps 204 which function as protective devices.

Since the ball rolling path means 184, 186, 188, and 190 are defined by structural members which are similar, only the ball rolling path means 184 will be described in detail. The ball rolling path means 184 is defined by a pair of elongated members 206 and 208 which are spaced a predetermined distance from each other by a pair of spacer balls 210 which are supported on a stud 212. The ends of the stud 212 are capped by clip balls 214. The elevated ends of the elongated members 206 and 208 are supported by a stud 216 which passes through holes 202 in the uprights 192 and 198.

As shown in FIG. 9, the apparatus 180 can be used by four individuals simultaneously or, in the alternative, one individual can move from one ball rolling path to another as dexterity is acquired in manipulating the ball 30.

It should be noted that all embodiments possess adjustability resulting from a combination of studs and holes in the elongated members. For example, the embodiment in FIG. 1 uses studs 56 engaging holes 54. Instead of using holes in the members, the ends of the studs could terminate in clamp members slidably adjustably mounted on the elongated members 22, 24. As a further example, the embodiment in FIG. 6 uses an apertured adjusting bar 170 which can be eliminated by using appropriate clamp members on stud 168 to lock the angular position of spaced legs 166 with respect to the spaced members 158. Similarly, the other studs 154, 160, and 164 could be provided with clamping terminals.

Various changes and modifications can be made to the invention as would be apparent to one of ordinary skill in the art in the light of this disclosure. These changes and modifications are part of the invention, which is limited only by the scope of the claims appended hereto.

What is claimed is:

1. An exercise and training device comprising a pair of spaced elongated members terminating in two pairs of adjoining ends and primarily intended to be placed so that one adjoining end is more elevated than the other, means for adjustably spacing said members at a predetermined distance from each other to define a rolling ball path therebetween, an additional elongated member spaced above a predetermined one of said elongated members in an upward direction, and upright members securing said additional elongated member to said predetermined elongated member, whereby said additional member and said predetermined member define a ball rolling path therebetween substantially in a vertical plane, said spacing means comprising one or more spacing balls for adjustably defining the spaced distance between said elongated members, and a stud adjustably passing transversely through said members and securing said balls between said members.

2. An exercise and training device comprising a pair of spaced elongated members terminating in two pairs of adjoining ends, means for spacing said members at a predetermined distance from each other, a ball rolling path defined by said members, a further elongated member spaced upwardly from a predetermined elongated member, and means for adjustably securing said further member to said predetermined member to define a ball rolling path substantially in a vertical plane, at least one bumper coupled to said spaced elongated members in proximity to one of said two pairs of adjoining ends and defining an end of said ball rolling path to improve ball rebounding, and means for adjustably elevating the position of each said bumper with respect to said pair of spaced elongated members.

3. An exercise and training device according to claim 2, intended to be placed so that one of said pairs of adjoining ends is more elevated than the other, at least one second bumper coupled to said spaced elongated members in proximity to another of said two pairs of adjoining ends and defining an end of said ball rolling path to improve ball rebounding, and means for adjustably elevating the position of each said second bumper with respect to said pair of spaced elongated members.

4. A device according to claim 2, including a counter supported by said elongated members and adapted to be actuated by the ball moving to the extremity of the ball rolling path.

* * * * *